US007168710B1

(12) United States Patent
Hennebry

(10) Patent No.: US 7,168,710 B1
(45) Date of Patent: Jan. 30, 2007

(54) ADJUSTABLE SUPPORT APPARATUS BETWEEN BOOT AND SNOWBOARD

(76) Inventor: Patrick Hennebry, 1619 N. Tulare Way, Upland, CA (US) 91784

( * ) Notice: Subject to any disclaimer, the term of this patent is extended or adjusted under 35 U.S.C. 154(b) by 0 days.

(21) Appl. No.: 11/193,751

(22) Filed: Aug. 1, 2005

(51) Int. Cl.
*A63C 9/082* (2006.01)

(52) U.S. Cl. ..... 280/14.24; 280/14.22; 280/607; 280/613; 280/618

(58) Field of Classification Search ..... 280/14.22, 280/607, 617, 618, 620, 629, 623, 14.21, 280/14.24, 14.23, 626, 632, 633, 634
See application file for complete search history.

(56) References Cited

U.S. PATENT DOCUMENTS

| | | | | | |
|---|---|---|---|---|---|
| 5,035,443 | A | | 7/1991 | Kincheloe | |
| 5,236,216 | A | | 8/1993 | Ratzek | |
| 5,277,635 | A | | 1/1994 | Gillis | |
| 5,354,088 | A | * | 10/1994 | Vetter et al. | 280/618 |
| 5,505,478 | A | | 4/1996 | Napoliello | |
| 5,553,883 | A | | 9/1996 | Erb | |
| 5,577,755 | A | * | 11/1996 | Metzger et al. | 280/607 |
| 5,586,779 | A | | 12/1996 | Dawes et al. | |
| 5,667,237 | A | | 9/1997 | Lauer | |
| 5,782,476 | A | | 7/1998 | Fardie | |
| 5,791,678 | A | * | 8/1998 | Perlman | 280/618 |
| 5,897,128 | A | * | 4/1999 | McKenzie et al. | 280/607 |
| 6,062,584 | A | * | 5/2000 | Sabol | 280/607 |
| 6,203,051 | B1 | * | 3/2001 | Sabol | 280/607 |
| 6,318,749 | B1 | * | 11/2001 | Eglitis et al. | 280/607 |
| 6,450,511 | B1 | * | 9/2002 | LaVoy | 280/14.22 |
| 6,467,794 | B1 | * | 10/2002 | De France | 280/607 |
| 6,520,531 | B1 | * | 2/2003 | Gien | 280/618 |
| 6,575,489 | B1 | * | 6/2003 | White | 280/613 |
| 6,910,707 | B1 | * | 6/2005 | Lyng | 280/618 |
| 2003/0057679 | A1 | * | 3/2003 | Pollmiller | 280/611 |
| 2003/0230870 | A1 | * | 12/2003 | Sabol | 280/618 |
| 2004/0207179 | A1 | * | 10/2004 | Sacco et al. | 280/623 |

* cited by examiner

*Primary Examiner*—J. Allen Shriver
(74) *Attorney, Agent, or Firm*—William W. Haefliger

(57) ABSTRACT

Adjustable support apparatus between a boot and a snowboard, comprising in combination a lower support plate connectible to a snowboard, an upper plate carried by the lower plate to be rotatable about a main upright axis, the upper plate connectible to a boot, a retainer connected to the support plate and holding the upper plate in position for rotation, about the axis, and an adjustable holder carried by one of the plates to project upwardly relative to the retainer, the holder having different positions of selectable connection to the other of the plates about the axis.

10 Claims, 6 Drawing Sheets

17
19
15
13
14
2
2
18
12
14a
16
11
25
21
44
14
10

25
14
24a
45
24a
26
46b
26
5
5
44
45
26
60
22
4
4
~11~

ADJUSTABLE SUPPORT APPARATUS BETWEEN BOOT AND SNOWBOARD

BACKGROUND OF THE INVENTION

This invention relates generally to adjustable support apparatus to be located between a snowboard and a user's boot, and particularly for accommodating rotation of the boot relative to the snowboard while the boot is held attached to the snowboard.

There is need for improvements in such adjustable apparatus providing reliability, compactness, and ease of rotary adjustment, for example while a snowboarder is on a lift.

SUMMARY OF THE INVENTION

It is a major object of the invention to provide improved apparatus meeting the above need. Basically, the preferred apparatus of the invention comprises:

a) a lower support plate connectible to a snowboard, b) an upper plate carried by the lower plate to be rotatable about a main upright axis, the upper plate connectible to a boot, c) a retainer connected to the support plate and holding the upper plate in position for rotation, about said axis, d) an adjustable holder carried by one of said plates to project upwardly relative to the retainer, the holder having different positions of selectable connection to the other of said plates about said axis.

Another object is to provide the retainer in the form of a ring extending about said main axis, the holder projecting upwardly through an opening about which the ring extends, for easy grasping by a user. Typically, the holder projects upwardly between the ring and the main axis, for ease of downward access by the user's hand, for enabling rotary adjustment.

Another object includes provision of an upper plate ledge on which the retainer extends to hold a lower portion of upper plate in a lower plate cavity. The ledge typically extends at least part way about said main axis, and the holder defining an upright axis and being adjustable substantially vertically for positioning in one of multiple selected positions corresponding to selected relative angular rotation of the plates.

A further object includes location of the holder to be carried by the upper plate to rotate with it, and relative to a series of holes in the lower plate into which lower extent of the holder is selectively receivable. In this regard, the upper plate may define boot connection openings, relative to which the holder projects upwardly in offset relation.

Yet another object is interconnection of the retainer ring and lower plate at locations outwardly of the upper plate, with respect to the main axis; and with the retainer ring and ledge both extending annularly about the main axis, thereby adding to compactness.

These and other objects and advantages of the invention, as well as the details of an illustrative embodiment, will be more fully understood from the following specification and drawings, in which:

DRAWING DESCRIPTION

DETAILED DESCRIPTION

Figure 1:
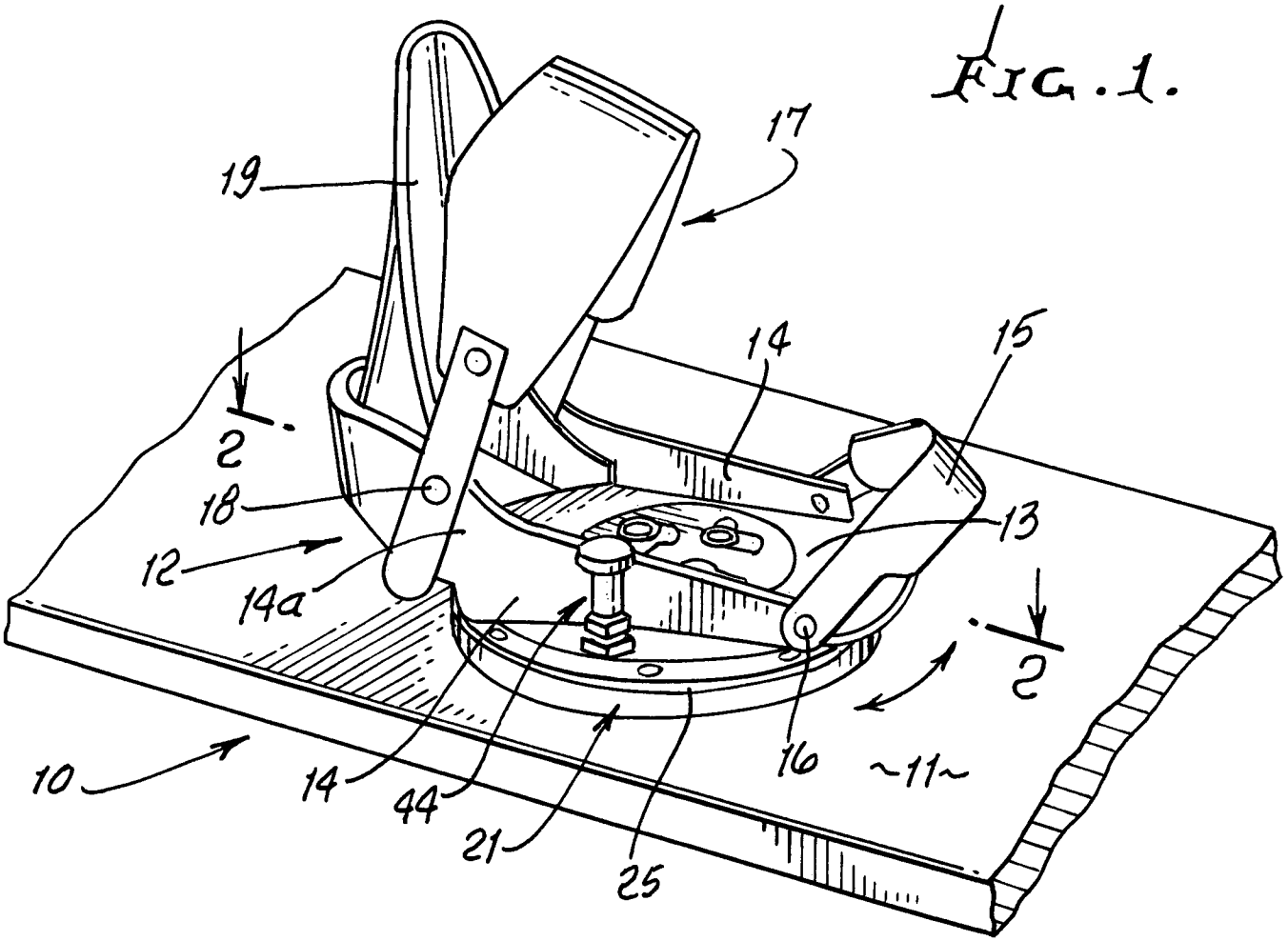
FIG. 1 is a perspective view of the apparatus of the invention, combined with a boot binding, and a snowboard.
Figure 2:
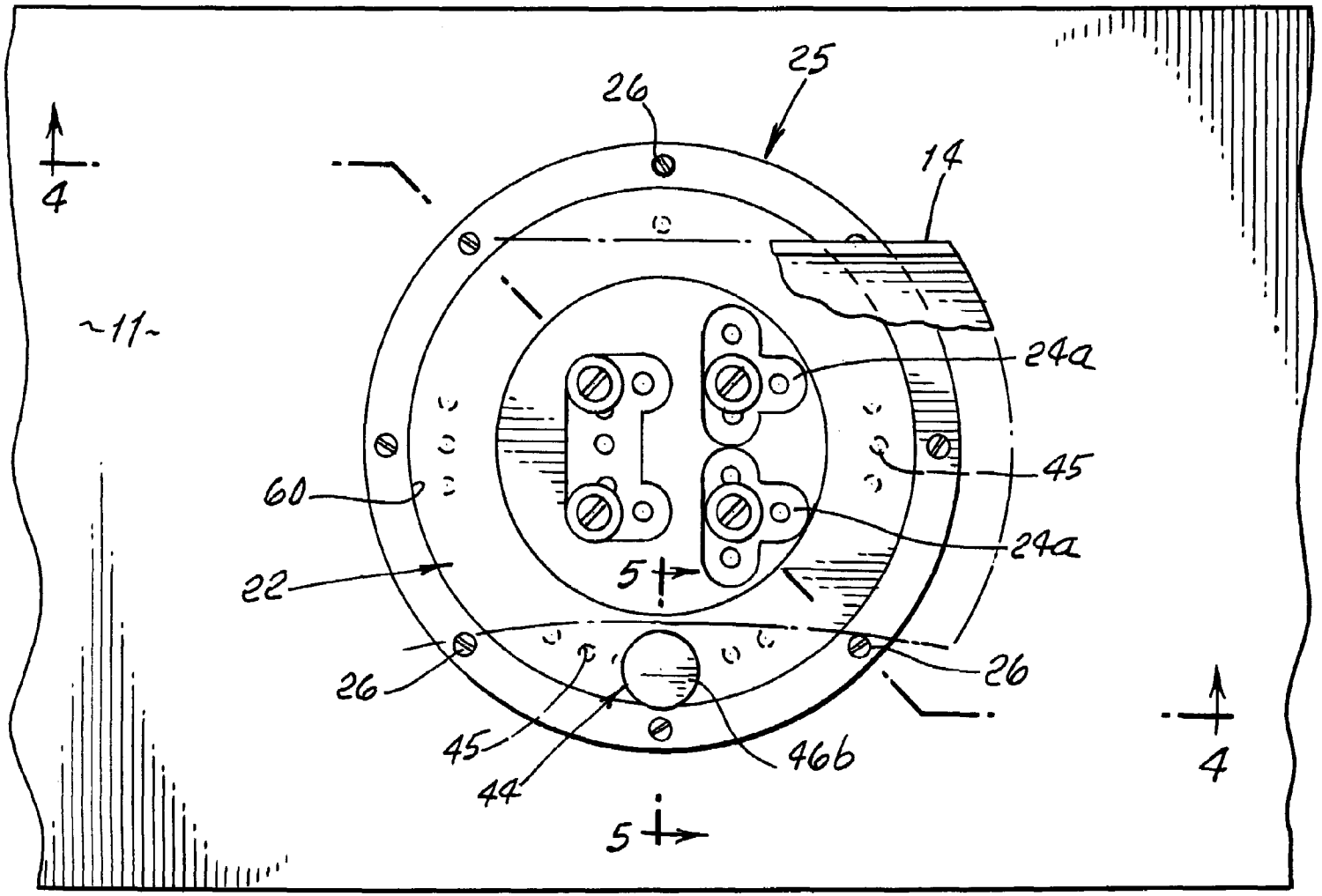
FIG. 2 is a plan view taken on lines 2—2 of FIG. 1.
Figure 3:
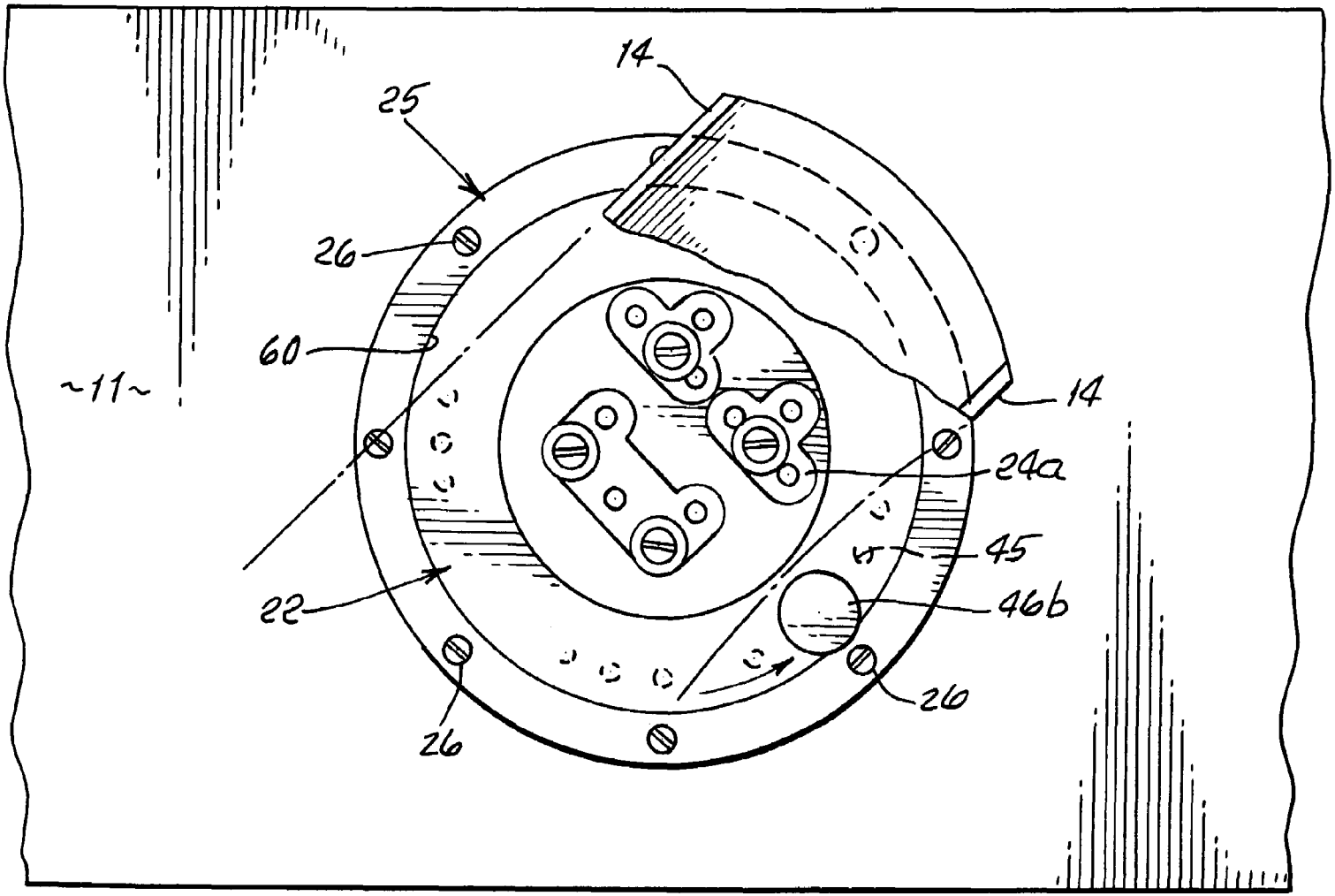
FIG. 3 is a view like FIG. 2, but showing the boot binding rotated relative to the snowboard.
Figure 4:
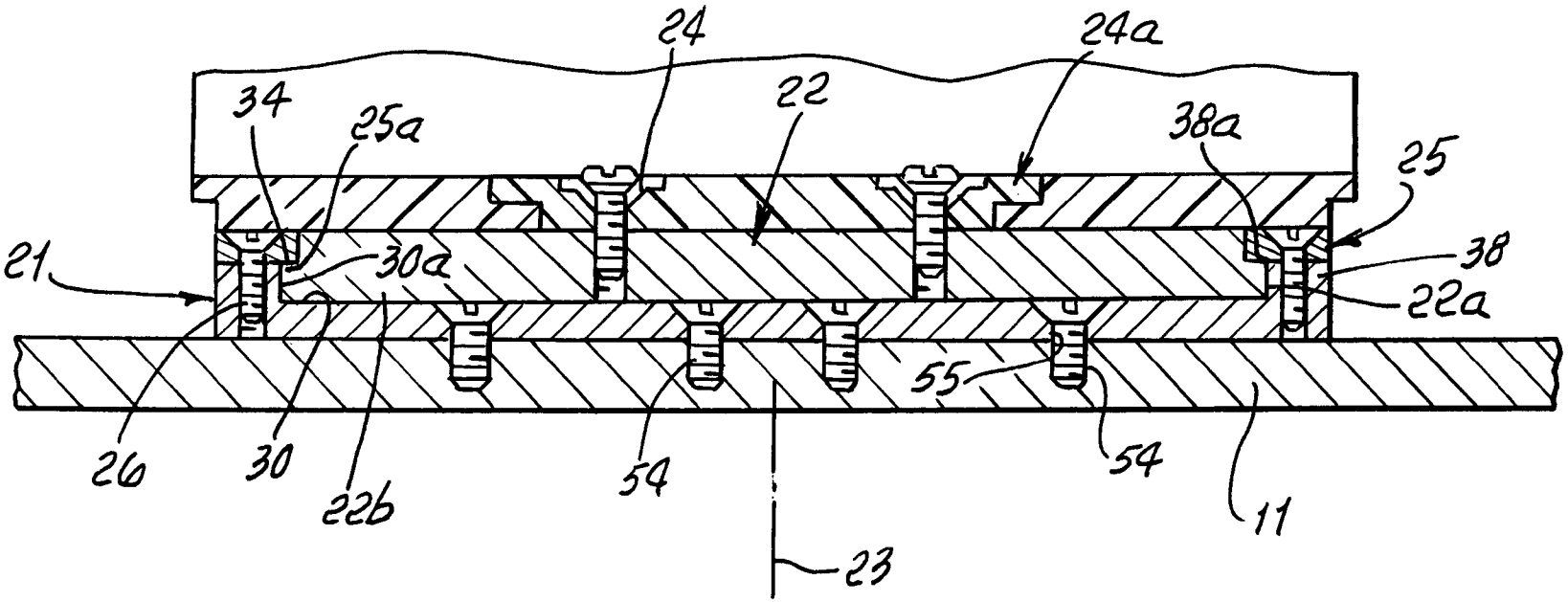
FIG. 4 is enlarged section taken on lines 4—4 of FIG. 2.

In FIG. 1 preferred support apparatus 10 incorporating the invention is shown as connected between a lower snowboard 11 and an upper boot binding 12. The binding includes a lower platform 13 attached to the apparatus 10; side uprights 14 between which a boot fits; a forward clevis 15 pivoted at 16 to uprights 14; a rearward clevis 17 pivoted 18 to rearward extents 14*a* of the uprights; and a rear boot brace 19.

Extending the description to FIGS. 2–7, they show elements of 10, in combination, as follows:

a) lower support plate, as at 21, connectible to the snowboard 11; as via fasteners 54 received in openings 55;

b) an upper plate as at 22, carried by 21 to be rotatable about a main upright axis 23, plate 22 connectible to a user's boot, as via fasteners that fit in openings 24 (see also boot connection structure 24*a*);

c) a retainer, as for example a ring 25, or section or sections of a ring, connected to support plate 21, as for example via fasteners 26, holding the upper plate in down position for rotation about central axis 23;

d) and an adjustable holder 44 carried by one of the plates, as for example upper plate 22, to project upwardly, relative to the retainer 25, for easy access by the user, the holder having different positions about axis 23 of selectable connection to the other of the two plates, about the axis.

It will be seen that holder accessible positioning, as referred to, is facilitated by projection upwardly through an opening or space about which the ring 25, or part thereof, or part of the retainer, extends, enabling ease of grasping above snow accumulation level on the board 11. See central opening 60, which also allows boot access and connection to plate 22.

Compact assembly of components is furthered by provision of a cavity 30 sunk downwardly in the lower plate 21, for reception of the upper plate 22. That cavity is preferably circular at 30*a* in outline, as is the periphery 22*a* of plate 22, whereby the loose interfit of these elements at 30*a* and 22*a* facilitates guided rotation of 22 about axis 23.

Figure 7:
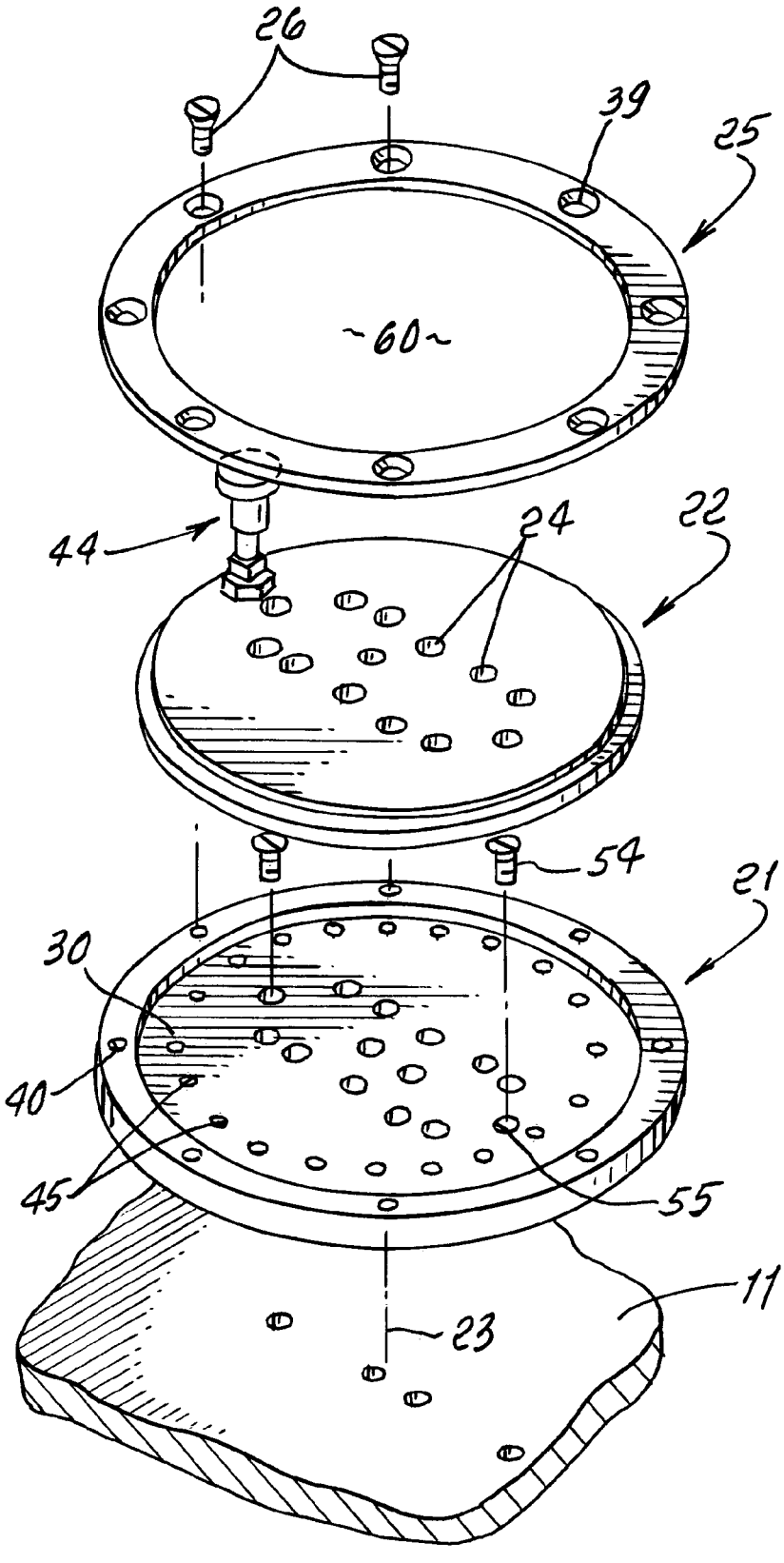
FIG. 7 is a perspective view of elements in axially exploded position.

The upper plate defines a ledge 34 over which the ring extends, as at overhang 25*a* to retain or hold the lower portion 22*b* of the upper plate in cavity 30, for guided rotation therein. Ledge 34 extends circularly about, or at least part way about, the main axis 23. Fasteners 26, spaced radially outwardly of the ledge, attach the ring to the lower plate annular upright flange 38, onto which the ring is clamped, at shoulder 38*a*. FIG. 7 shows a circular series of holes 39 in the ring, and holes 40 in the flange, for reception of the fasteners 26.

Figure 5:
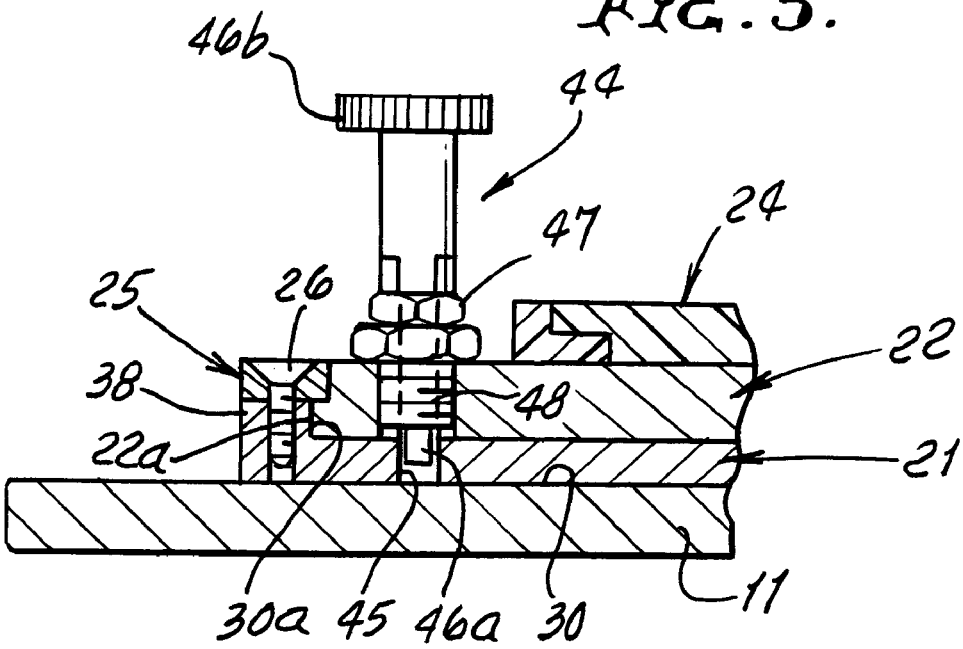
FIG. 5 is an enlarged section taken on lines 5—5 of FIG. 2, and showing a locking position.
Figure 6:
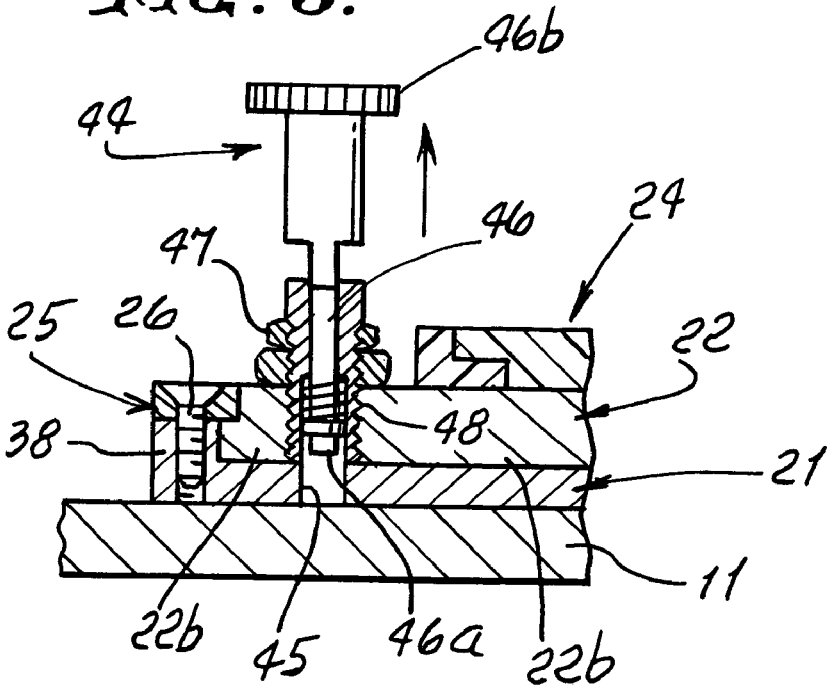
FIG. 6 is a view like FIG. 5 but showing an unlocked condition.

The holder 44 is typically carried by the upper plate to rotate therewith about axis 23, and relative to a circular series of holes 45 in the lower plate, into which lowermost extent 46*a* of holder pin or plunger 46 is selectively receivable. FIG. 5 shows the plunger lowermost extent 46*a* received in a hole 45 to lock the plate 22 to the plate 21; and FIG. 6 shows plunger lowermost extent 46*a* elevated out of hole 45, by pulling up on the plunger head 46*b*, to allow plate 22 adjustable rotation as by the user as he sits on a mountain side lift. Head 46*b* is positioned well above the plate and ring, for easy access, above snow accumulation level on the plates. Holder structure 47 attaches to plate 22, via thread connection at 48.

I claim:

1. Adjustable support apparatus between a boot and a snowboard, comprising in combination:

a) a lower support plate connectible to a snowboard, b) a single upper plate carried by the lower plate to be rotatable about a main upright axis, the upper plate connectible to a boot, the upper plate received downwardly into a central cavity sunk downwardly into the lower plate, c) a retainer ring connected to the support plate and holding the upper plate in position for rotation, about said axis, the upper plate having a central portion projecting above the top surface level of said cavity and bounded by a ledge and a lower plate ledge downwardly engaged by said ring, the ring extending about said central portion, d) an adjustable holder carried by one of said plates to project upwardly relative to the retainer, the holder having different positions of selectable connection to the other of said plates about said axis, e) the lower plate having a plurality of vertical through openings intersecting said cavity, for reception of fasteners connecting the lower plate to a snowboard.

2. The combination of claim 1, wherein the holder projects upwardly through an opening in the upper plate and about which the ring extends, for grasping by a user.

3. The combination of claim 2 wherein the holder projects upwardly between the ring and said axis.

4. The combination of claim 1 wherein the cavity everywhere extends below the level of said ledge.

5. The combination of claim 4 wherein the upper plate is the only plate received in said cavity.

6. The combination of claim 5 wherein the ledge extends at least part way about said main axis, the holder defining an upright axis and being adjustable substantially vertically for positioning in one of said selected positions corresponding to selected angular rotation of the plates.

7. The combination of claim 6 wherein the holder is carried by the upper plate to rotate therewith, and relative to a series of holes in the lower plate into which lower extent of the holder is selectively receivable, said through opening being circularly bounded by said series of holes.

8. The combination of claim 1 wherein the upper plate defines boot connection openings.

9. The combination of claim 6 wherein the retainer and lower plate are interconnected, outwardly of said upper plate, relative to said main axis.

10. The combination of claim 8 wherein said retainer and said lower plate ledge both extend annularly about said main axis, and about said boot connection openings.

* * * * *